US005636529A

United States Patent [19]

Schmidt

[11] Patent Number: 5,636,529

[45] Date of Patent: Jun. 10, 1997

[54] PROCESS FOR INTERMEDIATE STORAGE OF A REFRIGERANT

[75] Inventor: Hans Schmidt, Wolfratshausen, Germany

[73] Assignee: Linde Aktiengesellschaft, Wiesbaden, Germany

[21] Appl. No.: 556,196

[22] Filed: Nov. 9, 1995

[30] Foreign Application Priority Data

Nov. 11, 1994 [DE] Germany ..... 44 40 405.0

[51] Int. Cl.[6] ..... F25J 1/00

[52] U.S. Cl. ..... 62/613; 62/619

[58] Field of Search ..... 62/600, 606, 611, 62/613, 619

[56] References Cited

U.S. PATENT DOCUMENTS 3,331,214 7/1967 Proctor et al. ..... 62/611

4,229,195 10/1980 Förg ..... 62/23

5,359,856 11/1994 Rhoades et al. ..... 62/611

*Primary Examiner*—Ronald C. Capossela

*Attorney, Agent, or Firm*—Millen, White, Zelano, & Branigan, P.C.

[57] ABSTRACT

Intermediate storage of the refrigerant of a refrigerant circuit in which the refrigerant is compressed, cooled and at least partially liquefied, expanded for refrigeration purposes and heated and vaporized in heat exchange with the process flow to be cooled, is performed by delivering refrigerant components which condense on the high pressure side of the refrigerant circuit at ambient temperature to a separator and storing them in the latter for the interim. Liquid refrigerant components within the cold area of the refrigerant circuit are routed to a high pressure storage tank and stored therein for the interim.

22 Claims, 1 Drawing Sheet

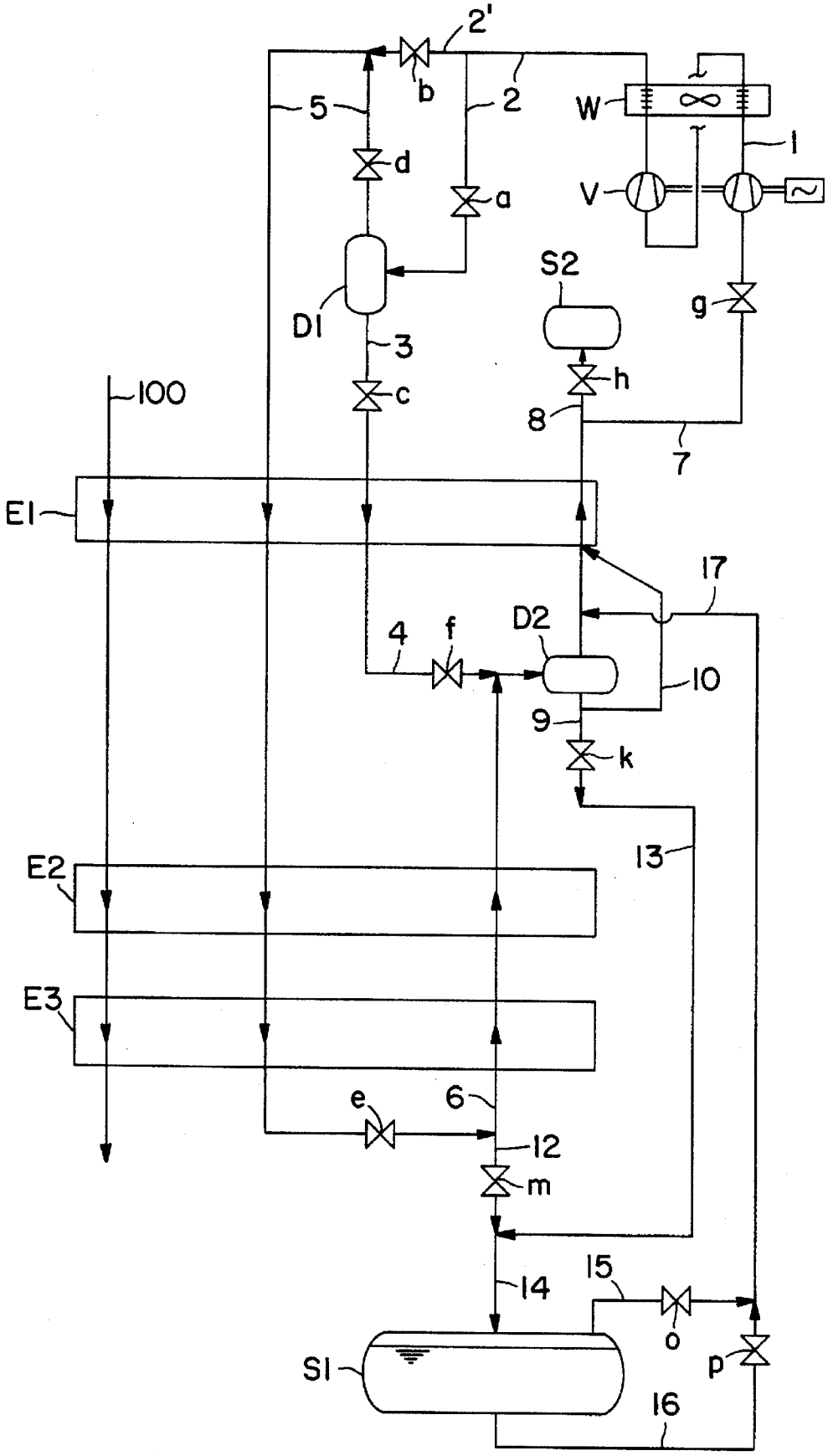
2'
b
2
5
W
1
d
a
V
S2
g
D1
3
h
100
c
8
7
E1
17
4
f
D2
10
9
k
13
E2
E3
e
6
12
m
14
15
o
p
S1
16

PROCESS FOR INTERMEDIATE STORAGE OF A REFRIGERANT

SUMMARY OF THE INVENTION

The invention relates to a process for intermediate storage of a refrigerant of a refrigerant circuit in which the refrigerant is compressed, cooled and at least partially liquefied, expanded for refrigeration purposes and heated and vaporized in heat exchange with the process flow to be cooled.

Refrigerant circuits are used in a host of processes, for example, liquefaction of pressurized natural gas. See, for example, DE-OS 28 20 212 (see also U.S. Pat. No. 4,229,195). If a plant in which a refrigerant circuit is incorporated must be shut down for a long time interval for maintenance reasons or because of a malfunction, the refrigerant used within the refrigerant circuit must be stored for the interim while the plant is shut down, due to high procurement costs or for environmental reasons. Since when a plant is shut down the refrigerant cycle is also shut down, as time passes the refrigerant heats up to ambient temperature. This means that the previously cold and liquid refrigerant can reach a very high pressure due to heating up to ambient temperature and due to the limited available volume.

For these reasons it is essential that either storage tanks be provided that can store the refrigerant if it warms up to ambient temperature or that the entire refrigerant circuit be designed to accommodate heating of the refrigerant to ambient temperature and the resultant pressures. In particular, the second alternative would, however, make the refrigerant circuit much more expensive.

An object of the invention is to provide a cost favorable process for intermediate storage of a refrigerant used in a refrigerant circuit in the case of a plant shutdown.

Upon further study of the specification and appended claims, further objects and advantages of this invention will become apparent to those skilled in the art.

These objects are achieved according to the invention by delivering refrigerant components which condense on the high pressure side of the refrigerant circuit at ambient temperature to a separator and storing them in the latter for the interim and delivering liquid refrigerant components within the cold area of the refrigerant circuit to a high pressure storage tank and storing them therein for the interim.

BRIEF DESCRIPTION OF THE DRAWING

Various other objects, features and attendant advantages of the present invention will be more fully appreciated as the same becomes better understood when considered in conjunction with the accompanying drawing, wherein:

FIG. 1 illustrates a process embodiment in accordance with the invention.

DETAILED DESCRIPTION

The invention and additional embodiments thereof are detailed using the Figure.

The refrigerant cycle shown in the figure is similar to known refrigerant cycles in that a refrigerant is compressed, cooled, expanded for purposes of generating refrigeration, subjected to heat exchange to cool a process stream, and then recompressed. For example, mixtures of $C_2$ to $C_3$ hydrocarbons or mixtures of nitrogen, methane, and $C_2$ and $C_5$ hydrocarbons can be used as refrigerants for a refrigerant circuit of this type.

The refrigerant or refrigerant mixture returned from the cold part of the plant is supplied by means of line 7 to single- or multistage compression, in this case two-stage compression V. After each compressor stage the refrigerant is cooled down, for example, against air, in a heat exchanger or cooler W. The pressure on the intake side of the first compressor is preferably about 3–10 bar, especially 3–6 bar, for example, about 4–6 bar, whereas the pressure on the pressure side of the second compressor is preferably about 20–60 bar, especially b 40–50 bar, for example, about 40–60 bar. The compressed refrigerant is then sent to separator D1 via line 2. During normal operation, shut-off valves a, c, d, g and h and expansion valves e and f are open, whereas shut-off valves b, k, m, o and p are closed.

At the top of separator D1 the light refrigerant components are removed via line 5 with valve d open and are passed through heat exchangers E1, E2 and E3 to expansion valve e. In doing so these refrigerant components liquefy. At this point they are expanded in expansion valve e, using the Joule-Thompson effect for refrigeration purposes, and are then routed by means of line 6 through heat exchangers E2 and E3 in counterflow to, e.g., a natural gas flow to be cooled in line 100 and high pressure refrigerant in lines 4 and 5. The refrigerant expanded in valve e is used to provide the peak colds necessary for liquefaction and cooling of the natural gas flow routed in line 100 through heat exchangers E2 and E3.

The heavy refrigerant components which are formed in separator D1 are removed at the bottom thereof via line 3 with valve c open. These refrigerant compounds are cooled in heat exchanger E1 and then expanded via line 4 and expansion valve f into separator D2, after prior mixing with the refrigerant components from line 6. Separator D2 is used to form a uniform two-phase mixture which supplies the cold needed for precooling the natural gas flow in heat exchanger E1. To form this two-phase mixture, at the top of separator D2 by means of line 7 light refrigerant components are withdrawn, while heavy refrigerant components are removed from the bottom of separator D2 via line 10. Directly at the inlet into heat exchanger E1 line 10 discharges into line 7 so that a uniform distribution of the two-phase mixture is achieved at the inlet of heat exchanger E1. A tapping line 8 with a shut-off valve h connects storage tank S2 to line 7. This storage tank S2 is used for intermediate storage of gaseous refrigerant. The remaining lines and valves shown are needed in the case of plant shutdown for the shutdown and restart procedure.

The shutdown procedure will be described first. At the beginning of shutdown, valve c is slowly closed. Expansion valves e and f remain open. As a result, all heavy refrigerant components of the refrigerant circuit which condense, according to the conditions of the heat exchanger or cooler W, at a pressure of 40–60 bar are stored in separator D1. Once this occurs, bypass valve b is opened in line 2' and then valves a and d are closed.

While compressor V continues to run, high pressure storage tank S1 is cooled down by means of a small partial flow which is removed from the bottom of separator D2 by means of line 9 with valve k open and routed via collecting main 14 into high pressure storage tank S1. The cooling down is preferably performed to avoid overstressing the piping and storage tank S1. The gaseous fraction which forms as a result within high pressure storage tank S1 is returned to separator D2 for pressure equalization via lines 15 and 17 with valve o open. The combined flow of lines 7 and 17 is delivered to separator D2 via lines 1, 2', 5 and 6.

At this point liquid discharge valves k and m are open so that all liquid portions of the refrigerant stored within the cold box on the low pressure side can reach high pressure storage tank S1 via lines 12, 13, and 14. While high pressure storage tank S1 is being filled, compressor V under partial load continues to run with bypass valve b open in order to liquefy as many of the light components of the refrigerant as possible so that high pressure storage tank S1 can be filled with them. According to one embodiment of the process according to the invention the liquid portions reach high pressure storage tank S1 by gravity.

At this point compressor V is shut off and after some time an equalization pressure of roughly 6–10 bar, e.g., 6–8 bar, is established in both the high pressure and low pressure sections of the refrigerant circuit. With expansion valves e and f opening 100%, the high pressure storage tank S1 is likewise filled with the liquid present on the high pressure side of the refrigerant circuit. The filling of high pressure storage tank S1 can be monitored via the liquid level therein.

When filling has finished, feed valves m and k and discharge valve o are closed. Valve p is closed during the described filling process of high pressure storage tank S1. The cold box now warms up slowly to ambient temperature. However, since only gas is stored in the cold box, the pressure now rises slightly to the shutdown pressure which is preferably about 5–40 bar especially 10–20 bar. Since high pressure storage tank S1 also slowly warms up to ambient temperature, it is necessary to design the tank to handle the resultant pressure increase. For conventional refrigerant circuits, designing the high pressure storage tank S1 to handle a pressure of 100–150 bar is sufficient. Storage tank S2, which can be optionally omitted, is used to hold the pressurized gas during the shutdown phase. Storage tank S2 acts as a buffer volume which can therefore be utilized to reduce the pressure increase of the refrigerant system during the warming-up of cold parts (of the refrigerant circuit) to ambient temperature.

The following describes the restart procedure of the refrigerant circuit. With bypass valve b and expansion valve e open, cycle compressor V is started up under the shutdown pressure. At this point bypass valve p is slowly opened on high pressure storage tank S1 and in this way the contents of high pressure storage tank S1 are slowly supplied to separator D2. High pressure storage tank S1 and separator D2 are both subjected to the suction pressure of the compressor V. Fluid flows from tank S1 due to the pressure difference between tank S1 and the suction pressure of the compressor V. After the pressure in high pressure storage tank S1 has fallen to the suction pressure of compressor V and no more liquid can be detected in high pressure storage tank S1, valve p is closed again so that high pressure storage tank S1 is hermetically blocked off. After valve b is closed and valves a, c, d and f are opened, the refrigerant circuit reaches its operating state within a short time.

Without further elaboration, it is believed that one skilled in the art can, using the preceding description, utilize the present invention to its fullest extent. The preferred specific embodiments are, therefore, to be construed as merely illustrative, and not limitative of the remainder of the disclosure in any way whatsoever.

In the foregoing, all temperatures are set forth uncorrected in degrees Celsius and unless otherwise indicated, all parts and percentages are by weight.

The entire disclosure of all applications, patents and publications, cited above, and of corresponding German application P 44 40 405.0, filed Nov. 11, 1994, are hereby incorporated by reference.

The preceding can be repeated with similar success by substituting the generically or specifically described reactants and/or operating conditions of this invention for those used therein.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for intermediate storage of a refrigerant of a refrigerant circuit, having a high pressure section and a low pressure cold section, wherein said refrigerant is compressed in at least one compression stage, cooled and at least partially liquefied, expanded for refrigeration purposes, and heated and vaporized by heat exchange with process flows to be cooled, said process comprising:

delivering components of said refrigerant which condense in said high pressure section of said refrigerant circuit at ambient temperature to a separator and storing said components in said separator; and delivering liquid refrigerant components within said cold section of said refrigerant circuit to a high pressure storage tank and storing said liquid refrigerant components in said high pressure storage tank.

2. A process according to claim 1, wherein said liquid refrigerant components within said cold section are delivered by gravity to said high pressure storage tank.

3. A process according to claim 2, further comprising storing non-condensable pressurized gas components of said refrigerant in a second storage tank.

4. A process according to claim 1, further comprising storing non-condensable pressurized gas components of said refrigerant in a second storage tank.

5. A process according to claim 1, wherein, during operation of said refrigerant circuit, said refrigerant is delivered to said separator wherein a first fraction which is gaseous is separated from a second fraction, which is liquid, said first fraction and second fraction are each individually cooled and expanded in expansion valves and then recombined, and wherein said high pressure storage tank is connected to said refrigerant circuit at a point which is downstream of the expansion valve, which expands said first fraction, and upstream from the point where said first fraction and second fraction are recombined.

6. A process according to claim 5, wherein said refrigerant circuit includes a second separator which is downstream of the point where said first and second fractions are recombined and upstream of said at least one compression stage and during intermediate storage liquefied refrigerant flows from said second separator to said high pressure storage tank and is stored therein.

7. A process according to claim 6, wherein said liquid refrigerant components within said cold section are delivered by gravity to said high pressure storage tank.

8. A process according to claim 7, further comprising storing non-condensable pressurized gas components of said refrigerant in a second storage tank.

9. A process according to claim 6, further comprising storing non-condensable pressurized gas components of said refrigerant in a second storage tank.

10. A process according to claim 4, wherein said liquid refrigerant components within said cold section are delivered by gravity to said high pressure storage tank.

11. A process according to claim 10, further comprising storing non-condensable pressurized gas components of said refrigerant in a second storage tank.

12. A process according to claim 5, further comprising storing non-condensable pressurized gas components of said refrigerant in a second storage tank.

13. A refrigerant circuit comprising:

at least one compression stage for compressing a refrigerant gas;

a first heat exchanger downstream of said compression stage for cooling and partially liquefying compressed refrigerant gas;

a separator for receiving cooled compressed refrigerant and separating condensed components of a refrigerant from uncondensed components thereof, and means for placing said separator in fluid communication with said first heat exchanger;

a first expansion valve, in fluid communication with said separator, for expanding condensed components and a second expansion valve, in fluid communication with said separator, for expanding uncondensed components;

first conduit means for combining fluid discharged from said first and second expansion valves and delivering combined fluids to a second separator;

second conduit means for removing fluid from said second separator and delivering fluid to a heat exchanger, for heat exchange with a stream to be cooled, and thereafter delivering fluid to said compression stage; and a storage tank and associated piping for placing said storage tank in fluid communication with said second expansion valve, said second separator or both.

14. A refrigerant circuit according to claim 13, further comprising a second storage tank and means for placing said second storage tank in fluid communication with said second conduit means.

15. A refrigerant circuit according to claim 13, further comprising third conduit means for placing said storage tank in fluid communication with said second conduit means.

16. A refrigerant circuit according to claim 13, further comprising a bypass conduit and means for placing said bypass conduit in fluid communication with said first heat exchanger and said second expansion valve whereby fluid discharged from said first heat exchanger can bypass said separator.

17. A refrigerant circuit according to claim 13, wherein fluid communication between said first expansion valve and said separator is provided by a first line having a valve which can be closed to prevent fluid flow through said first line.

18. A refrigerant circuit according to claim 17, wherein fluid communication between said second expansion valve and said separator is provided by a second line having a second valve which can be closed to prevent fluid flow from said separator through said second expansion valve.

19. A refrigerant circuit according to claim 18, further comprising a bypass line which provides fluid communication between said first heat exchanger, at a point upstream of said separator, and said second line at a point downstream of said second valve.

20. A process for operating a refrigerant circuit comprising:

compressing a refrigerant medium in at least one compression stage;

after discharge from the last compression stage, cooling said refrigerant medium to provide a cooled, compressed refrigerant medium;

delivering said cooled and compressed refrigerant medium to a first separator wherein said medium is separated into a stream of light refrigerant components and a stream of heavy refrigerant components;

cooling and expanding said stream of light refrigerant components discharged from said first separator, and heating the resultant expanded stream of light refrigerant components by heat exchange with a stream to be cooled;

cooling and expanding said stream of heavy refrigerant components discharged from said first separator;

combining the expanded stream of heavy refrigerant components and the expanded stream of light refrigerant components and delivering the resultant mixture to a second separator;

removing a first refrigerant stream from the top of said second separator and a second refrigerant stream from the bottom of said second separator and, prior to delivery to a further heat exchanger, combining said first and second refrigerant streams to form a two-phase mixture;

heating said two-phase mixture in said further heat exchanger by heat exchange with said stream to be cooled whereby the latter is pre-cooled; and removing said refrigerant medium from said further heat exchanger and delivering same to said at least one compression stage.

21. A process for shutting down a refrigerant circuit comprising:

closing a valve positioned within a conduit for removing condensed refrigerant components from a first separator and delivering said condensed refrigerant components to a first expansion valve, said first separator being positioned downstream of at least one compression stage for compressing refrigerant medium wherein at least one heat exchanger is positioned between the last compression stage and said first separator for cooling compressed refrigerant medium;

opening a first bypass valve in a first bypass conduit, closing a valve in a conduit for delivering compressed refrigerant medium from said at least one compression stage to said first separator, and closing a valve in a conduit for removing uncondensed refrigerant components from said first separator, whereby condensed refrigerant medium discharged from said at least one compression stage bypasses said first separator;

cooling a first storage tank;

delivering liquefied components of said refrigerant medium to said first storage tank wherein, during the filling of said first storage tank with liquefied refrigerant components, said at least one compression stage is shut off and an equalization pressure is established within the refrigerant circuit;

after filling said first storage tank with said liquefied refrigerant components, isolating said first storage tank from said refrigerant circuit and optionally, upon warming of the refrigerant circuit to ambient temperature, storing gas within said refrigerant circuit that has increased in pressure due to warming in a second storage tank.

22. A process for restarting a refrigerant circuit which has been shut down in accordance with claim 21, comprising:

starting said at least one compression stage while said first bypass valve is open and a second expansion valve in a conduit connected to said first bypass conduit is also open;

opening a second bypass valve in a second bypass conduit which connects said first storage tank with a second separator, whereby the contents of said first storage tank are supplied to said second separator;

after the pressure in said first storage tank has fallen to the suction pressure of said at least one compression stage, closing said second bypass valve in said second bypass; and closing said first bypass valve in said first bypass, opening said valve in said conduit for delivery of compressed refrigerant medium to said first separator, opening said valve in said conduit for the removal of condensed refrigerant components from said first separator, opening said valve in said conduit for removing uncondensed refrigerant components from said first separator, whereby condensed refrigerant components discharged from said first separator are expanded in said first expansion valve and then delivered to said second separator.

* * * * *